United States Patent [19]

Kumar et al.

[11] Patent Number: 4,781,121

[45] Date of Patent: Nov. 1, 1988

[54] SYSTEM FOR ENHANCING TRACTION AND ENERGY EFFICIENCY IN TRAINS

[76] Inventors: Sudhir Kumar; Shiv R. Kumar, both of 17 W. 434 Sutton Pl., Westmont, Ill. 60559

[21] Appl. No.: 30,719

[22] Filed: Mar. 25, 1987

[51] Int. Cl.[4] ..... B61F 19/00; B08B 1/02; B08B 3/02

[52] U.S. Cl. ..... 104/279; 291/1; 15/256.5; 239/174

[58] Field of Search ..... 104/279; 291/1, 2, 3; 239/173, 174

[56] References Cited

U.S. PATENT DOCUMENTS

| | | | |
|---|---|---|---|
| 523,208 | 7/1894 | Kallauner | 104/279 |
| 929,737 | 8/1909 | Weismantel | 104/279 |
| 2,057,474 | 10/1936 | Borrows et al. | 104/279 |
| 2,766,056 | 10/1956 | Hudson | 291/2 |
| 2,853,957 | 9/1958 | Dean et al. | 104/279 |
| 2,890,970 | 6/1959 | Allen | 104/279 |
| 3,198,137 | 8/1965 | White, Jr. | 291/3 |
| 3,685,454 | 8/1972 | Ogilvy et al. | 104/279 |
| 3,850,691 | 11/1974 | Bleil et al. | 104/279 |
| 3,877,387 | 4/1975 | Kasai | 105/49 |
| 3,906,866 | 9/1975 | Knippel | 104/139 |
| 3,982,164 | 9/1976 | De Buhr | 318/52 |
| 3,997,822 | 12/1976 | Logston, Jr. | 318/52 |
| 4,101,014 | 7/1978 | Matheson | 104/279 |
| 4,230,045 | 10/1980 | Fearson | 104/279 |
| 4,327,649 | 5/1982 | Kreissig | 105/199 R |
| 4,431,227 | 2/1984 | Howell | 295/33 |
| 4,485,743 | 12/1984 | Roush | 105/176 |

OTHER PUBLICATIONS

Railway Locomotives and Cars, "Could Sparking Improving Adhesion?", Jun. 1961, pp. 50 and 51.

*Primary Examiner*—George L. Walton
*Attorney, Agent, or Firm*—Kinzer, Plyer, Dorn, McEachran & Jambor

[57] ABSTRACT

A method and apparatus for enhancing traction capacity and energy efficiency of locomotives and powered cars while helping to maintain the crown of the rail profile for better ride quality of trains. This is achieved by utilizing beneficially the effects of lateral creepage of a number of small, hard nonpowered cleaning wheels with alternately opposite angles of attack. The apparatus may include deflector shields and hot air jets for cleaning and preparing the rail crown surface, when the apparatus is used in locomotives or cars. An arrangement for automatically adjusting the angle of attack of the cleaning wheels is also given. The degree of cleaning of the rails can be electrically controlled by the locomotive engineer as desired including shutting off the device altogether.

16 Claims, 9 Drawing Sheets

SYSTEM FOR ENHANCING TRACTION AND ENERGY EFFICIENCY IN TRAINS

BACKGROUND OF THE INVENTION

This invention is concerned with a system or device for increasing the traction and braking capacity of a wheel on a rail while reducing the energy consumed by the wheel per unit load and simultaneously helping to maintain the rail crown profile.

There is a great need in the railroad industry to pull long and heavy trains with as few tractive units as possible. The locomotives or other tractive units used have been made heavy and with high powered diesel/electric or all electric drive systems to increase their tractive capability. The weight per axle has already been increased to a limiting capability of the tracks. Further increase in the power of the plant on board will not increase the tractive capability of the locomotive unless the wheel-rail contact conditions are improved. The adhesion/creepage characteristics of the contact shown in FIG. 1 (for clean, dry laboratory conditions 10, typical low contamination rail 11, and moderate contamination rail 12) make it clear that great improvements in adhesion levels are possible when the rail is cleaned. Furthermore, a cleaner rail surface leads to reduced creepages which lead to reduction of energy loss of a tractive contact.

Most of the improvements in modern locomotion to date have been internal to the engine. Not much has been done externally to improve the wheel-rail contact conditions. The approaches used to date include: (1) the application of sand, and (2) a special creepage control system used on the driving axles. Sand usage is very bad for the rail and wheel, as well as the locomotive bearings. Sand should be avoided as much as possible. It fouls up the track, wears out the rail and wheel at a very fast rate and reduces engine life. Creepage control is good, but it can run into problems when the rail is intermittently excessively contaminated. In the future it is expected that rails will be even more contaminated due to increased rail lubrication by railroad companies for reducing fuel consumption. Thus, what is urgently needed is an external system that will prepare the rail crown for high adhesion capability before the wheel rolls on it.

Another problem that has developed in the last few decades is the flattening of the rail head crown in a short period of service, due to considerably increased axle loads needed on modern freight trains. A damaged rail crown leads to bad car dynamics, poor ride quality and damaged freight. The progressive railroad companies tackle the problem by grinding the rail crown to restore profile and/or by using head-hardened or high-strength alloy rails. Both choices add considerably to track maintenance costs. It will therefore be very helpful economically to the railroads if the system used to prepare the rail crown for the train also helps to maintain the proper rail crown curvature. A system which will prepare the rail surface and help maintain the curvature of its crown would benefit all locomotion (diesel/electric as well as all electric) and provide better rail economics with improved profits. In the area of locomotion, it will especially benefit the creepage control systems by enabling them to operate continually in a stable, high adhesion zone. The present invention provides a solution to all three problem areas discussed above. It will improve adhesion, reduce creepage and related contact energy loss, and help to maintain rail crown profile.

SUMMARY OF THE INVENTION

This invention is a rail dressing device which can be mounted on or be an integral part of locomotives, powered cars or special rail cleaning vehicles for enhancing their traction and energy efficiency. It also helps to maintain the rail crown profile. It uses two, four or more non-powered rail cleaning wheels of hard steel or other abrasive/composite material loaded to produce a suitable contact stress between the cleaning wheels and the rail. These wheels are set at alternately opposite angles of attack to the rail between 0.5 and 10 degrees and with suitably offset wheel center locations. The cleaning wheels have tread profiles which develop contact in overlapping adjacent parts of the rail crown. One rail dressing device is mounted ahead of the lead wheel of the vehicle for each rail, but it can be mounted also in the middle or rear positions as needed.

The rail dressing device takes advantage of large lateral creepage in the cleaning wheel contact for cleaning the rail surface and exposing some new metal for better adhesion of the following tractive wheels, while keeping the energy losses quite small and maintaining the rail crown profile for longer periods. The angle of attack of the cleaning wheels can be fixed or automatically adjustable.

Additions of hot air jets, plasma jets or brushes can be used for further augmenting the rail treatment capability under different conditions. The hot air jets are located inside a rail debris deflector shield which is mounted on the base plate of the device ahead of its front wheel. There is also provided a powered screw arrangement with which the device can be picked up and made inoperational or partially operational as desired by the locomotive engineer. Use of this device will thus produce higher traction or braking force capability of a given locomotive while reducing energy consumption by the powered wheels and simultaneously helping to maintain the proper rail crown profile. Various changes may be made in the details of the construction and arrangement of parts and certain features may be used without others. All such modifications within the scope of the appended claims are included in the invention.

One of the objects of the invention presented here is to increase adhesion levels of wheels on rails of the trains on which it is installed.

The rail dressing device of the present invention clans the rail head surface, removing contaminants such as diesel fuel, oil, grease, other organic material, thin ice layer and loose material like rust, dirt, etc. Regular use of this system on all trains of a given route will help maintain the cleanliness of the rail crown surface as well as the rail crown profile radius by moving a very thin layer of the metal laterally in a way that counters flattening of the rail crown as it commonly develops under heavy haul operation.

The rail dressing device of the invention reduces slip or creepage of the main powered driving wheels, thereby reducing the energy consumed by the wheel in producing the same level of adhesion as without it.

The invention complements and enhances modern locomotives or powered cars with benefit. It can be included in the design of future locomotives where optimum benefit can be obtained by providing more space for installing an optimized version of the system.

The device carries a rail debris deflector shield to remove any sm all objects fallen on the rails or a layer of snow left unremoved by the front shield of the locomotive.

When using a special option, the rail dressing device can be raised from the rails so that cleaning of the rails is done only when it is desired.

Furthermore, the rail dressing device of the invention does not require electrical power for its operation. It becomes operational when the train moves. It can be attached to the lead truck of a locomotive or powered car, or it can be attached to the front plate and/or the body of the car.

A high capacity version of the device can be attached to the car body or locomotive body in the middle, for higher levels of cleaning and adhesion of the rail.

For railroads unable to install this system on their locomotives, it can be mounted on special track maintenance powered vehicles which can operate on the rails at frequent intervals to clean the rail crown. This will improve the performance of trains that follow.

For those railroads that are planning to lubricate their tangent track for increased fuel efficiency, use of this device is considered essential to maintain the rail crown clean and usable for good traction.

BRIEF DESCRIPTION OF THE DRAWINGS

FIG. 3 is a force schematic of the device of FIG. 12.

DETAILED DESCRIPTION OF THE INVENTION

This invention is directed to a method and a mechanical system or device which, when used on tractive rail vehicles such as locomotives and powered cars, enhances their traction/braking capability and reduces the energy losses in the rail-wheel contact by preparing and cleaning the rail surface as the tractive vehicle wheels roll on it. It simultaneously helps in maintaining the rail crown profile.

Figure 1:
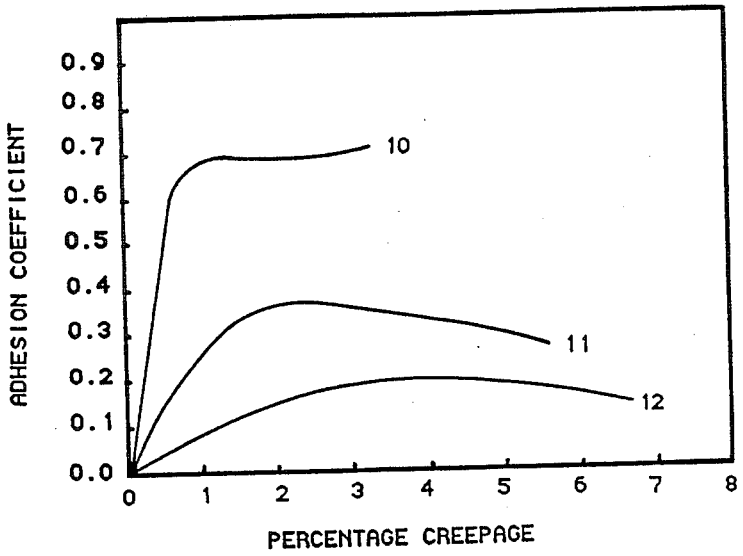
FIG. 1 shows three typical longitudinal adhesion-creepage characteristics of a tractive wheel on rail: laboratory clean dry conditions 10 and typical low 11 and moderately contaminated 12 rail conditions in the field.
Figure 3:
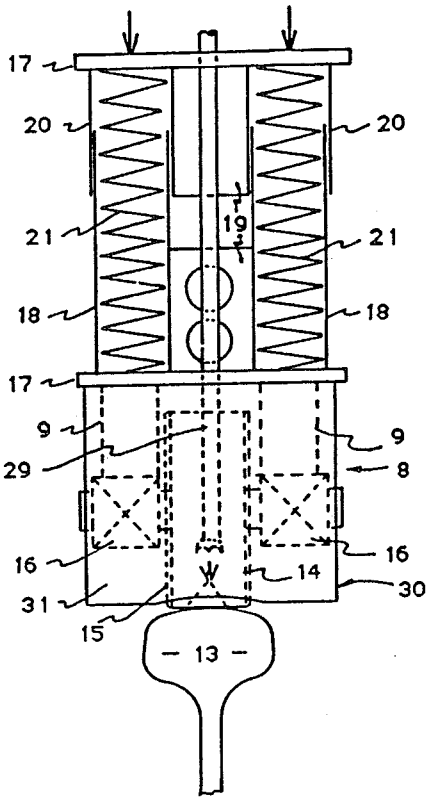
FIG. 3 is a front elevation view of the rail dressing device.
Figure 2:
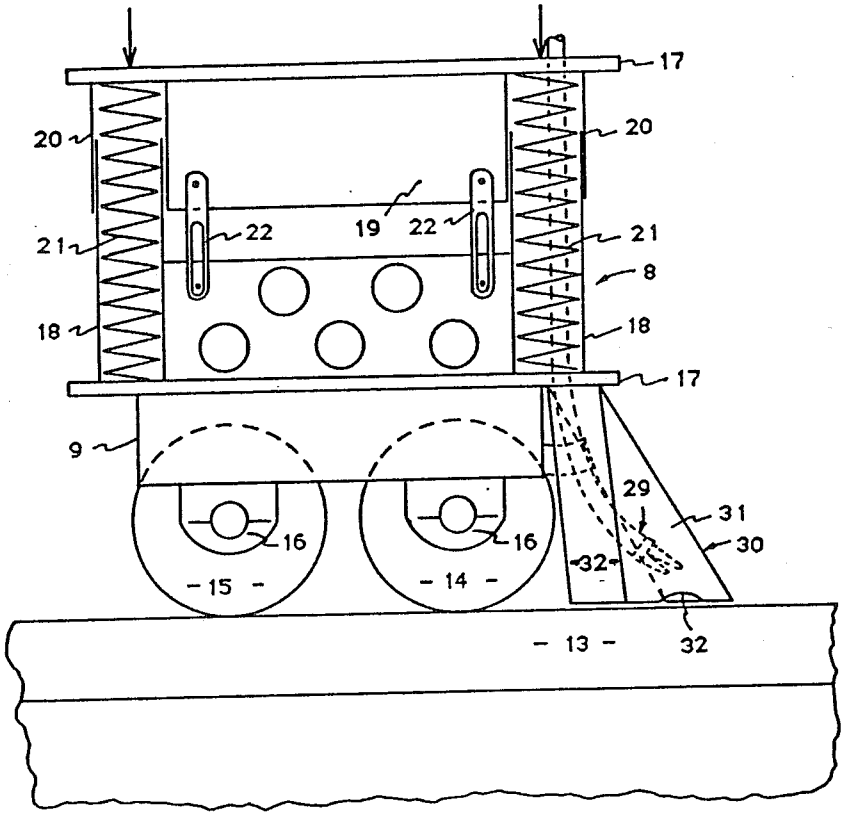
FIG. 2 shows a side elevation view of the rail dressing device of the present invention.

The tractive/braking capability of a wheel on a rail depends on its adhesion-creepage characteristics. FIG. 1 shows these characteristics of wheel on rail under three different conditions. Under clean, dry conditions of the laboratory 10, the adhesion levels attained are much higher than experienced by the wheels on rails in the field conditions 11, 12. One major reason for this is that the rails, in outdoor operational conditions, collect contaminants such as a fine layer of diesel fuel, oil, water, rust and organic material in the form of a very high-viscosity slurry. When such contaminants are applied to the rail in the laboratory, reductions of adhesion result, such as those observed in the field for minute contamination 11 or moderate contamination 12. When the rail dressing device 8 (FIGS. 2 and 3) of the present invention is used, these surface contaminants are pushed laterally and partially burnt or evaporated by the large lateral creepages of two high contact-stress cleaning wheels 4, 15 on rail 13. The cleaning wheels are of small diameter (8 in. to 12 in.) to enable high stress development with small loads. They are made of high strength, hard steel or other hard abrasive materials depending on whether the device is used on a locomotive, powered car or special track cleaning car. They are firmly held in position by thrust roller bearings 16 which are mounted on side plates 9 of a box-like frame having upper and lower plates 17. The frame includes springs 21 in tubes 18, 20 and stiffening plates 19 so that prescribed loads can be transmitted through the springs and plates to the cleaning wheels 14, 15. The lower stiffening plates of the frame have a number of holes to avoid accumulation of water. The springs 21 in the tubes 18, 20 have a stiffness such that their compression by an appropriate amount will produce the force needed for the requisite contact stress between the cleaning wheels 14, 15 and the rail 13. The force is applied through the upper plate 17 at locations shown by the arrows when the device is installed on a locomotive or powered car. The magnitude of this force will depend on the size and type of wheels 14, 15 and the application desired. For references purposes only, a wheel-rail contact stress of 200 ksi has been found to be suitable for smooth, high hardness cleaning wheels. The upper and lower parts of the frame are held together by two sliding latches 22 on each side for easy transport when the unit is not installed. It will be understood that the suspension system shown for mounting the cleaning wheels could include suitable dampers for limiting vibration.

Figure 4:
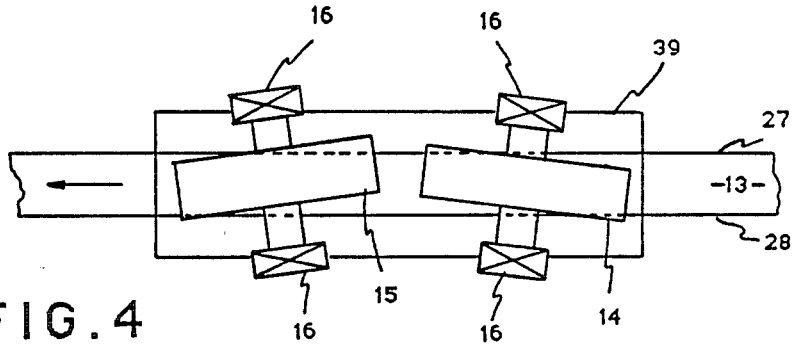
FIG. 4 is a schematic plan view of the angles of attack of the two cleaning wheels with the angles exaggerated for illustrative purposes.
Figure 5:
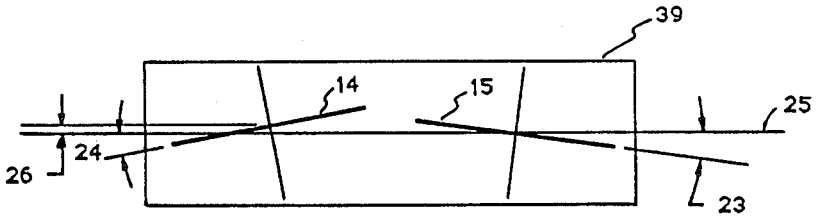
FIG. 5 is a diagrammatic showing of the placement of the cleaning wheels with respect to the rail.

The cleaning wheels 14, 15 are set in the rail dressing device 39 at non-zero angles of attack 23, 24 with respect to the longitudinal rail axis 25 as shown in FIGS. 4 and 5. Also their center points are displaced laterally with respect to each other by a small distance 26. The magnitude of the angle of attack is recommended to be smaller than ten degrees and generally larger than 0.5 degrees, depending on the extent of cleaning needed. The distance 26 laterally between the center points of the two wheels will depend on the wheel profiles chosen and the rail crown profile on which this device operates, but a typical value of one-quarter inch can be used. The rolling direction of the device is shown with an arrow on the rail 13 with the gage and the field sides marked as 27 and 28, respectively. A similar rail dressing device with a reflected image orientation is located on the other rail.

The lateral creepage of the cleaning wheels 14, 15 has the effect of machining the rail head an extremely small amount. A microscopic, thin layer of rail head steel is removed and pushed to either side of the rail head by the cleaning wheels. The removed layer will be less than 2 to 3 microns thick and less than an inch wide. Of course, the slurry of contaminants on this thin layer is similarly pushed aside, leaving a newly-exposed rail head contact surface for the immediately-following tractive wheels. This new surface approximately approaches laboratory clean conditions for improved adhesion. The removed layer of the rail is so thin that the effect on rail life is negligible. In fact, use of the rail dressing device may enhance rail life by serving to maintain the rail crown profile and thereby reduce the need for regrinding the head.

Recognizing that a significant component of the rail surface contamination is moisture, two tubes 29 are provided ahead of the cleaning wheel 14 in the rolling direction. The tubes direct jets of very hot air at the rails. These jets are aimed forwardly, with one aimed toward each side of the rail starting from the central position. The jets will push excess moisture away from the rail crown and dry the surface. Once the rail surface is dried the lateral creepage of the cleaning wheels 14, 15 will remove other contaminants from the surface. The hot air jets are, however, considered an optional feature.

A deflector shield 30 is mounted under the leading edge of the lower plate 17 to protect the cleaning wheels from large debris on the rail head. The shield is made of steel and may have a nylon/steel reinforced rubber insert adjacent to the rail. The embodiment shown has a plow 31 set at an angle with respect to the rail to deflect debris to the field of the rail. Skirts 32 attached to the plow complete the shield and form an enclosure about the hot air jets 29. Reinforcing ribs may be located on the inside of the shield. The shield serves several important functions. It deflects any objects lying on the rail, thus protecting the device from damage. It also removes any snow on the rail and it helps contain hot air from the jets to assist in cleaning/drying of the rail.

Figure 6D:
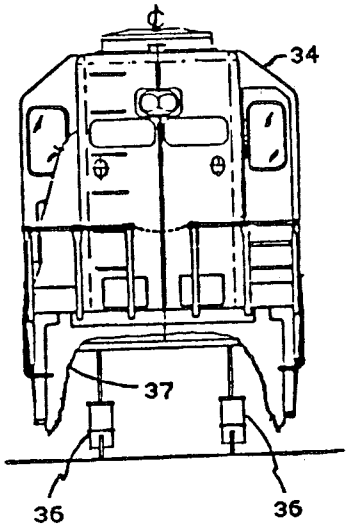
FIGS. 6C and 6D are side and rear elevations respectively, of a locomotive, with portions cut away, showing the devices of the invention mounted near the rear of the locomotive.
Figure 6C:
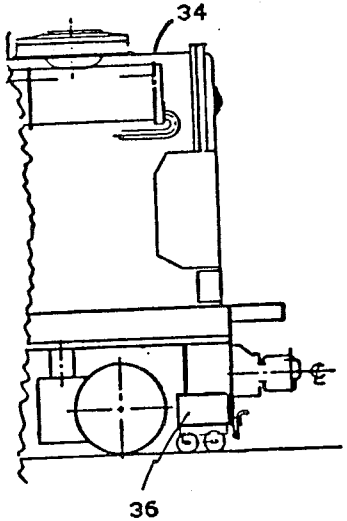
Figure 6B:
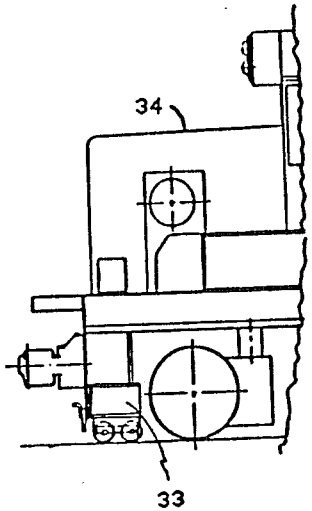
FIGS. 6A and 6B are front and side elevations, respectively, of a locomotive, with portions cut away, showing rail dressing devices of the invention mounted near the front of the locomotive.
Figure 6A:
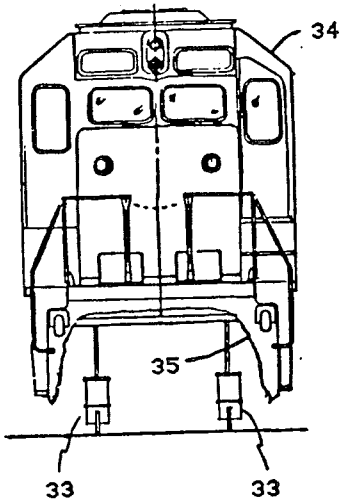

FIGS. 6A and 6B show the location of two rail dressing devices 33 according to the invention, one on each rail in the front part of a locomotive 34. The front view of the locomotive 34 shows the front plate 35 cut out to reveal the two devices. The rail dressing devices can be mounted both in the front and rear locations for extra cleaning. FIGS. 6C and 6D show rail cleaning devices 36 mounted at the rear of locomotive 34. The rear location device 36 will clean for any trailing locomotives. It will also clean as the lead device when the locomotive is driving backwards. FIG. 6D, with the rear plate 37 cut out, shows the rear devices 36 on each rail.

Figure 7:
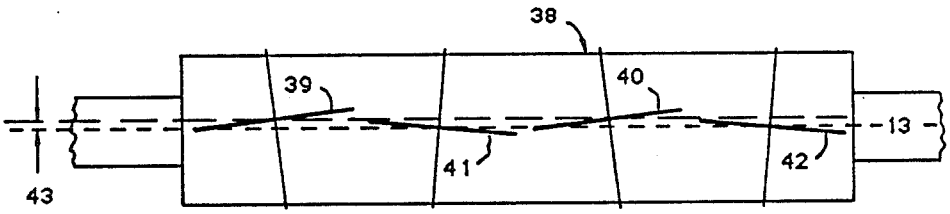
FIG. 7 is a schematic plan view of an alternate embodiment, showing a four-wheel rail dressing unit, with adjacent cleaning wheels having angles of attack in alternate directions.
Figure 8:
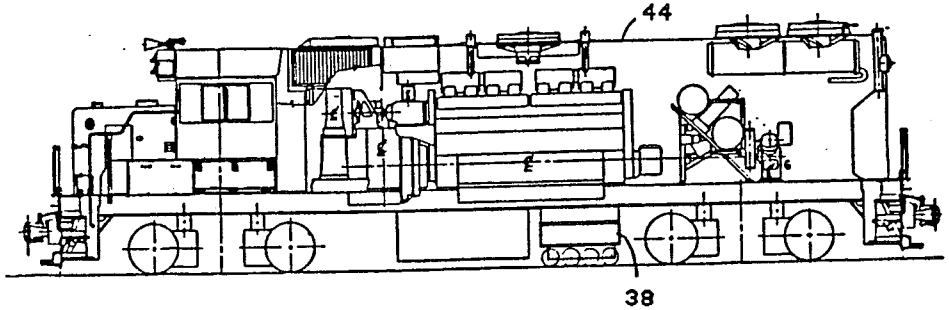
FIG. 8 shows the central location of multiple wheel devices for a locomotive.

When space permits, a rail dressing device 38 with four or more cleaning wheels as shown in FIG. 7 can be used on the rail 13 for extra cleaning. Two wheels 39, 40 have an angle of attack in one direction, while the other two 41, 42 are set in the opposite direction. The center points of the two sets of wheels are displaced laterally by distance 43, as before. While the angles of attack of adjacent wheels have been shown in the preferred alternating directions, they can be arranged in any other fashion. FIG. 8 shows that such a rail dressing device 38 could be located in the central part of the locomotive 44, if the fuel tank does not occupy all the space. Rail dresssing devices could also be mounted in the front and rear locations of the locomotive (as in FIGS. 6A–6D) in addition to the central device 38.

Figure 9:
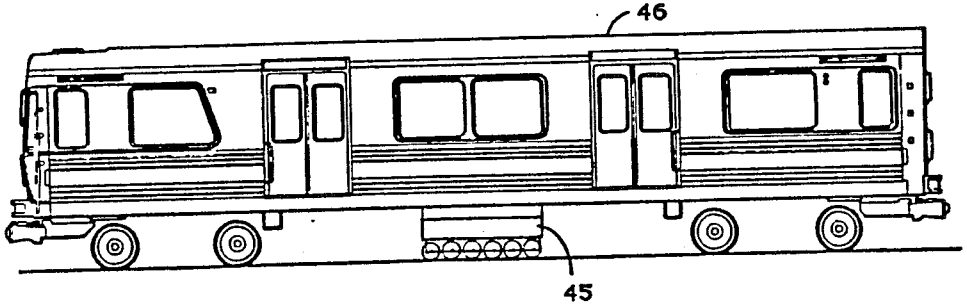
FIG. 9 shows the central location of multiple wheel devices for a powered car.

A rail dressing device 45 with six cleaning wheels could be used on a powered car 46 as shown in FIG. 9.

Figure 10:
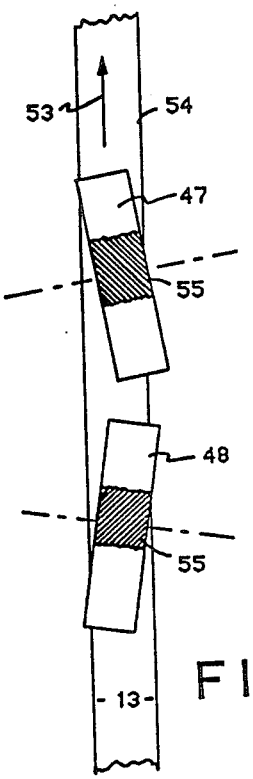
FIG. 10 is a view similar to FIG. 4, showing a part of the cleaning wheel surface like a fine file.
Figure 11A:
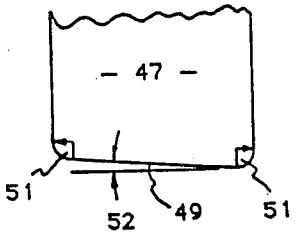
FIGS. 11A and B show two suggested cleaning wheel profiles.
Figure 11B:
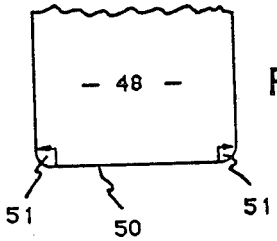

Various profiles of the cleaning wheels can be used, designed for cleaning of different strips along the rail crown. FIG. 10 shows a leading cleaning wheel 47 followed by a trailing wheel 48. Two suggested profiles 49, 50 for U.S. rail are shown in FIGS. 11A and 11B for these wheels. The edges of the profiles have a radius (approximately ¼ inch) shown at 51. The lead wheel 47 profile 49 has a conicity (1:10) as at 52, while the trailing wheel 48 is cylindrical. The two cleaning wheels 47, 48 shown on the rail 13 are rolling in the direction marked by the arrow 53 with the gage side 54 also shown (FIG. 10). The small part of the wheel surface shown hatched indicates a file-like surface 55 to be used for special cleaning vehicle wheels. When this type of cleaning wheel is used, the average wheel-rail contact stress can be reduced to about 50 ksi. For locomotive use the cleaning wheels can be a very hard steel without the filing ridges.

Figure 12:
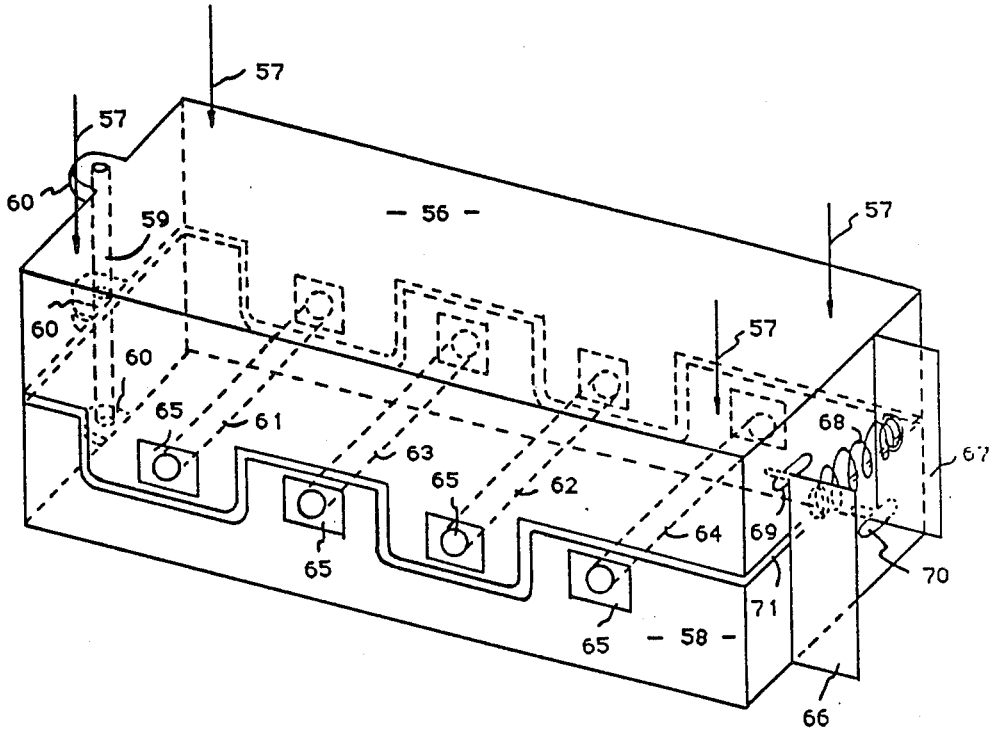
FIG. 12 is an isometric view of a device for automatically adjusting the angles of attack of the cleaning wheels, showing the location of the axles of four wheels in the unit.
Figure 13:
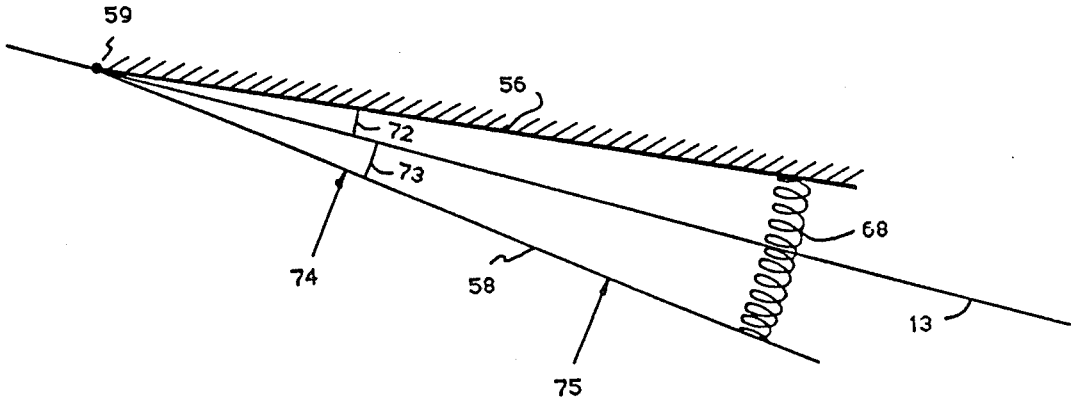

FIGS. 12 and 13 illustrate an alternate embodiment of a rail dressing device. Here, the angle of attack 73 of the cleaning wheels is automatically adjustable. Only the axles 61, 62, 63, 64 of the cleaning wheels are shown for simplicity. The frame carrying the wheels is split into upper and lower parts 56, 58 with the upper part 56 fixed to the locomotive structure. The frame is loaded at four locations shown by arrows 57. The lower part 58 of the frame can pivot about the rod 59 through the hinges 60. A special bearing 71 not seen in the view is supporting the load at the end opposite to the pivot 59. The bearing 71 may comprise a plurality of balls held in an arcuate raceway. The bearing blocks 65 of two axles 61, 62 are part of the upper frame, while the bearing blocks of the other two axles 63, 64 are built in the lower frame. Axles 61, 62 have a design value of the angle of attack 72. However, the angle of attack 73 of the other two axles 63, 64 (and, hence, of their associated cleaning wheels) varies with the lateral creepage forces 74, 75 and the selected stiffness of the spring 68. The rail direction is marked with a line 13 in the lower part of FIG. 13. The spring is supported between two plates 66, 67, each with one edge welded to the upper or lower box. A rodlike extension of the plates goes through slots 69, 70 to permit variation of the angle 72 plus 73 within a prescribed range. This range can be up to ten degrees or so. The variability of the angle of attack will permit more cleaning of dirtier rails automatically.

Figure 14:
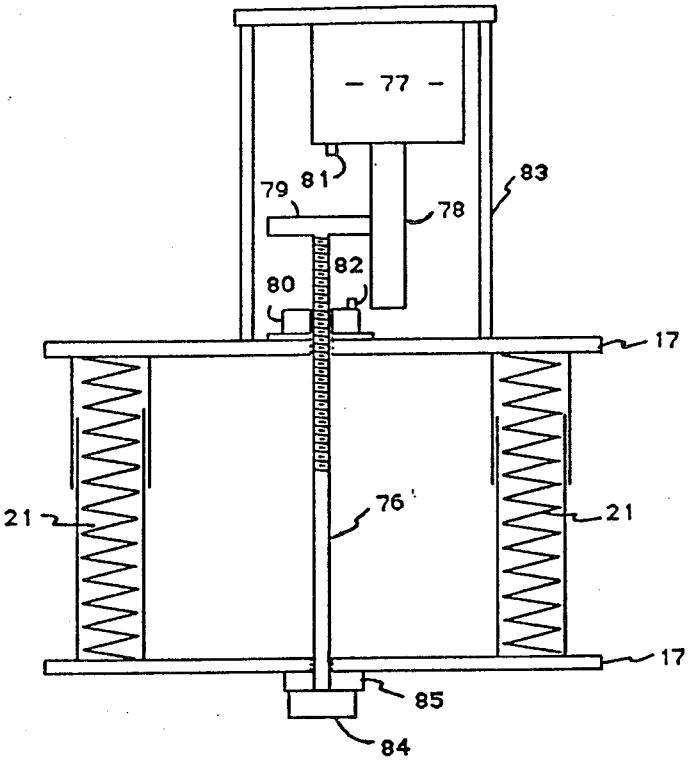
FIG. 14 is a side elevation view of a portion of the frame according to an alternate embodiment.

Another option shown in FIG. 14 is a provision for raising and lowering the device so it can be engaged with the rails only when it is desired or when the adhesion requirements are high. When it is not needed, the wheels of the device are raised by a few inches so that they will not contact the rails. This is achieved by using a centrally located, vertical power screw 76 to raise the lower plate 17 while compressing all four springs 2]. The screw is driven by a bidirectional electrical motor 77 with a gear reduction arrangement mounted on top of the upper plate 17. The motor 77 has a long gear 78 attached to its shaft. This gear drives a larger gear 79 attached to the powered screw shaft 76. The long gear transmits torque to shaft 76 while permitting up and down movement of the large gear 79. The screw 76 is guided and controlled by a large threaded nut 80 mounted permanently on upper plate 17. There are two electrical limit switches 81, 82 provided at the upper and lower limiting positions of gear 79 to turn the motor 77 off automatically when the gear 79 hits them. The whole arrangement is sealed in a housing 83 mounted on the upper plate 17. The lower end of the screw 76 goes through a hole in the lower plate 17 and has a large bolt head 84 with bearings 85 in between the head 84 and the lower plate 17. In the fully lowered position this screw will permit the device to operate with full spring force. In the fully raised position the springs are compressed to the maximum and the wheels are not in contact with the rail, thus making the device inoperative. In the partially lowered position of the screw head 84, the cleaning wheels experience only partial vertical load on the wheel-rail contacts, thereby permitting lesser cleaning of the rails. The locomotive engineer can thus increase or decrease the amount of cleaning of the rails manually as needed. Use of this option does require, however, that electrical power be provided to the device for operating the motor 77 and the limit switches 81, 82.

While the invention has been described in several of its aspects with respect to embodiments thereof, it will be understood and appreciated that variations and modifications may be made without departing from the spirit or scope of the invention.

What is claimed is:

1. A device for increasing the adhesion capacity of a tractive vehicle's powered wheels on rails, comprising:

a frame attached to the tractive vehicle in advance of at least one of the powered wheels; and at least one cleaning wheel mounted for rotation on the frame in engagement with the rail at a non-zero angle of attack with respect to the longitudinal axis of the rail such that the resulting lateral slip of the cleaning wheel on the rail due to lateral creepage cleans a continuous thin strip the rail crown surface for better adhesion of following powered wheels.

2. The device of claim 1 further characterized in that there are at least two cleaning wheels mounted on the frame at alternately opposite non-zero angles of attack.

3. The device of claim 2 further characterized in that the cleaning wheel centers are laterally offset.

4. The device of claim 2 wherein the profile of one of the cleaning wheels is conical while the profile of the other cleaning wheel is cylindrical.

5. The device of claim 1 further comprising a tube for directing a fluid jet against the rail surface.

6. The device of claim 1 further characterized in that the tread of the cleaning wheel has a roughened, file-like surface.

7. The device of claim 1 further comprising means for automatically adjusting the angle of attack of the cleaning wheel.

8. The device of claim 1 wherein the frame has a plurality of springs compressed a suitable amount to apply an appropriate load on the cleaning wheels.

9. The device of claim 8 further characterized in that the frame has upper and lower plates with the springs disposed between the plates.

10. The device of claim 1 further comprising means for raising the frame to a point where the cleaning wheels are out of contact with the rails.

11. The device of claim 1 further comprising a shield disposed ahead of the cleaning wheels to protect them from large foreign objects on the rail.

12. The device of claim 1 further characterized in that the angle of attack of the cleaning wheel is between about 0.5° and about 10°.

13. The device of claim 1 wherein the lateral creepage of the cleaning wheels removes surface contaminants.

14. The device of claim 13 wherein the lateral creepage of the cleaning wheels removes an extremely thin layer of metal from the rail surface

15. A method of increasing the adhesion capacity of a tractive vehicle's powered wheels on rails comprising the step of contacting the rail crown surface with a cleaning device mounted at a specific orientation so as to produce a lateral slip of the device on the rail and thereby remove a continuous thin layer of the rail head metal immediately before the powered wheel makes contact with that portion of the rail, thereby also removing contaminants from the rail which would otherwise reduce adhesion.

16. The method of claim 15 further characterized in that the cleaning device is a cleaning wheel and the step of removing a thin layer of metal is performed by running said cleaning wheel on the track with the cleaning wheel specific orientation being a non-zero angle of attack with respect to the longitudinal axis of the rail, thereby producing lateral creepage of the cleaning wheel.

* * * * *